US007454160B2

(12) United States Patent
Ojima et al.

(10) Patent No.: US 7,454,160 B2
(45) Date of Patent: Nov. 18, 2008

(54) DEVELOPING APPARATUS INCLUDING A CYLINDRICAL DEVELOPER CARRYING MEMBER CONVEYING A MAGNETIC MONO-COMPONENT DEVELOPER

(75) Inventors: Masaki Ojima, Mishima (JP); Masahito Kato, Susono (JP); Nobuyoshi Yoshida, Shizuoka-ken (JP); Satoru Inami, Numazu (JP); Tadashi Dojo, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 11/671,320

(22) Filed: Feb. 5, 2007

(65) Prior Publication Data

US 2008/0089722 A1 Apr. 17, 2008

Related U.S. Application Data

(63) Continuation of application No. PCT/JP2006/321194, filed on Oct. 18, 2006.

(30) Foreign Application Priority Data

Oct. 13, 2006 (JP) ..... 2006-280337

(51) Int. Cl.
*G03G 15/09* (2006.01)

(52) U.S. Cl. ..... 399/267; 430/122.51

(58) Field of Classification Search ..... 399/267, 399/270, 277, 53, 55; 430/122.51, 122.5, 430/122.1

See application file for complete search history.

(56) References Cited

U.S. PATENT DOCUMENTS 5,517,286 A 5/1996 Tada et al. ..... 399/274
6,453,138 B1 9/2002 Inoue et al. ..... 399/159
7,043,175 B2 * 5/2006 Komoto et al. ..... 399/270 X
2003/0215731 A1 * 11/2003 Saiki et al. ..... 430/110.3

FOREIGN PATENT DOCUMENTS

| | | |
|---|---|---|
| JP | 63-068847 | 3/1988 |
| JP | 5-265249 | 10/1993 |
| JP | 6-110324 | 4/1994 |
| JP | 6-295130 A | 10/1994 |
| JP | 7-098546 | 4/1995 |
| JP | 2001-235898 | 8/2001 |
| JP | 2002-082528 | 3/2002 |
| JP | 2005-156987 | 6/2005 |
| JP | 2005-345618 | 12/2005 |

* cited by examiner

*Primary Examiner*—Sophia S Chen
(74) *Attorney, Agent, or Firm*—Fitzpatrick, Cella, Harper & Scinto

(57) ABSTRACT

A developing apparatus, a process cartridge and an image forming apparatus which form an image whose image density can be maintained, which form a fogged image and which form an image of uneven density within an acceptable range, even when the diameter of a developer carrying member is not more than 12 mm. The apparatus includes a developer carrying member whose outer diameter is in the range of 8 mm to 12 mm, and a magnetic mono-component developer 43 having a saturation magnetization of in a range of 20 $Am^2/kg$ to 37 $Am^2/kg$ when the magnetic field of 79.6 kA/m (1000 oersteds) is applied, the magnetization of not less than 70% and not more than 80% of the saturation magnetization when the magnetic field is lowered to 55.7 kA/m (700 oersteds), and the magnetization of not less than 50% and not more than 62% of the saturation magnetization when the magnetic field is lowered to 39.8 kA/m (500 oersteds).

3 Claims, 5 Drawing Sheets

DEVELOPING APPARATUS INCLUDING A CYLINDRICAL DEVELOPER CARRYING MEMBER CONVEYING A MAGNETIC MONO-COMPONENT DEVELOPER

This application is a continuation of International Application No. PCT/JP2006/321194, filed Oct. 18, 2006, which claims the benefit of Japanese Patent Application No. 2006-280337, filed Oct. 13, 2006.

BACKGROUND OF THE INVENTION

1. Field of the Invention

The present invention relates to a developing apparatus and a process cartridge that adopts a non-contact development system using a magnetic mono-component developer for making visible the electrostatic latent image formed on an image bearing member by way of an electrophotographic printing method, an electrostatic recording method, and the like.

2. Description of the Related Art

In recent years, there is a growing need for more compact and higher speed image forming apparatus, in which images are formed by the electrophotographic printing method, the electrostatic recording method, and the like employed as a printer or copier for personal use. In addition, in view of the maintenance of such apparatus, convenience is sought for a developing unit/a cleaning unit including a toner/a waste toner which can be detachably mountable to the main body of the apparatus.

In order to achieve the compactness, the image bearing member, the developer carrying member, and the like used in the apparatus are required to make the diameter thereof smaller. In particular, in a non-contact development system (i.e., toner projection development (jumping development)) as described in Japanese Patent Application Laid-Open No. H06-110324, as the diameter of a photosensitive drum, which serves as an image bearing member, or a developing sleeve, which serves as a developer carrying member, are made smaller, the developing region is also made smaller. A developing sleeve, which has a diameter of 12 mm or less, has been required to achieve compactness.

The aforementioned term "developing region", as shown in a region "X" in FIG. 6 of the accompanying drawings, denotes a region in which a bias voltage applied between a photosensitive drum 1 and a developing sleeve 41 and an alternating electric field formed by the latent image potential allow the toner to fly and be involved in the developing process. In conjunction with the present invention, the developing region will be described in greater detail hereinbelow.

The electric field mentioned above is set in such a way to prevent the occurrence of an electric discharge at a position nearest to the photosensitive drum 1 and the developing sleeve 41. The intensity of the electric field will become weaker, as shown in FIG. 6, as the photosensitive drum 1 and the developing sleeve 41 move in a transverse direction with reference to the nearest position in FIG. 6, due to the fact that the distance between the photosensitive drum 1 and the developing sleeve 41 is made wider. As a matter of course, as the photosensitive drum 1 and the developing sleeve 41 have a smaller diameter, (i.e., as each of them has a greater curvature) the photosensitive drum 1 and the developing sleeve 41 will rapidly have a greater distance therebetween, leading to a rapidly weaken intensity of the electric field. Accordingly, the range of the intensity of the electric field sufficient for the toner 43 to fly can be limited to the vicinity of the nearest position.

The first harmful effect caused by a narrower developing region is a decline in the density due to an insufficient toner supply. When various developing conditions are changed in order to compensate for the decreased density and maintain an appropriate density level, there may be a case that a fogged image or an uneven density can occur as described in Japanese Patent Application Laid-open No. H06-110324.

In use of a magnetic toner, the magnetic force contained in the developing sleeve should be made weaker as a measure to prevent the aforementioned problems from occurring. In this manner, a magnetic binding force applied to the magnetic toner on the developing sleeve can be weak so that the toner can fly easily while preventing the decline in the density.

This can certainly widen the developing region and prevent the decline in the density, however, the toner that has not been sufficiently charged (low toriboelectricity) also flies to increase the risk of the fogged image or the spatter of the toner in the apparatus.

The magnetization of the magnetic toner induced by the magnetic force of the magnet can be lowered for the toner to fly easily. For this purpose, there is a case shown in Comparative Example 2 in Japanese Patent Application Laid-open No. H06-110324 wherein a magnetic toner with a lower residual magnetization is used, however, more fogged image and uneven density were observed and thus considered to be not appropriate for practical use.

In the toner projection development, the behavior of the magnetic toner with lowered residual magnetization is described in Japanese Patent Application Laid-Open No. 2005-345618. It shows that the magnetic brush of the magnetic toner that is under the magnetic field can be easily broken and can be close to a state of a toner cloud in which each of the magnetic toner particles separately behaves when the residual magnetization of the magnetic toner is low.

It is further suggested in Japanese Patent Application Laid-Open No. 2005-345618 that the magnetic brush of the magnetic toner can be more easily broken as the degree of circularity of the toner particles is higher. It is yet further suggested in Japanese Patent Application Laid-Open No. 2005-345618 that a toner projection development in a state of a cloud can reduce a so-called edge effect in which the magnetic toner is gathered to the edge of the latent image, and bring out an effect in which a difference between the solid image portion and the line image portion is smaller.

Moreover, in accordance with a tendency of a developing sleeve smaller in diameter (12 mm or less in diameter), the number of revolutions of the developing sleeve per page increases and thus the risk of fusion bonding of the toner on the developing sleeve increases. In accordance with the high speed printing using the developing sleeve with a smaller diameter and the greater durability (longer life) of the developing apparatus, the shortage in the toner supply and the toner fusion bonding on the developing sleeve described above tend to deteriorate, and hence there are many restrictions on achievement of this.

The toner projection development with a small developing region must be conducted under various constraints. In particular, in the case where the developing sleeve has a diameter of less than 12 mm, the toner supply shortage can be caused even when the amount of charged toner as described in Japanese Patent Application Laid-Open No. H06-110324 is maintained and the density cannot be maintained at a continuous output of the images with a high coverage rate.

As a method of physically increasing the amount of toner supply, it may be conceived that the ratio of the circumferential speed of the developing sleeve to the photosensitive drum can be raised. However, it is not desirable in that the number of revolutions of the developing sleeve is increased as described above. Also, a method of changing the condition of regulating the amount of the toner on the developing sleeve to increase the toner carrying amount makes it difficult to obtain an appropriate triboelectricity or triboelectricity distribution, leading to a harmful effect caused by the fogged image, the uneven density, and the like and increasing the possibility of degrading the image quality.

It is an effective measure to provide a larger electric field from the developing sleeve to the photosensitive drum by changing the developing bias. However, in many cases, the maximum value of the electric field has already been set nearly to an upper limit, in which no electric discharge occurs in the nearest position of the photosensitive drum and the developing sleeve, and thus the value cannot be made higher any more.

SUMMARY OF THE INVENTION

It is an object of the present invention to provide a developing apparatus and a process cartridge which can maintain the image density and restrict the fogged image and the uneven density at an acceptable level or less even when the outer diameter of the developer carrying member is 12 mm or less.

Further features of the present invention will become apparent from the following description of exemplary embodiments with reference to the accompanying drawings.

DESCRIPTION OF THE EMBODIMENTS

Hereinafter, the developing apparatus and the image forming apparatus according to the present invention will be described in a greater detail with reference to the accompanying drawings.

(Overall Configuration of the Image Forming Apparatus)

Figure 1:
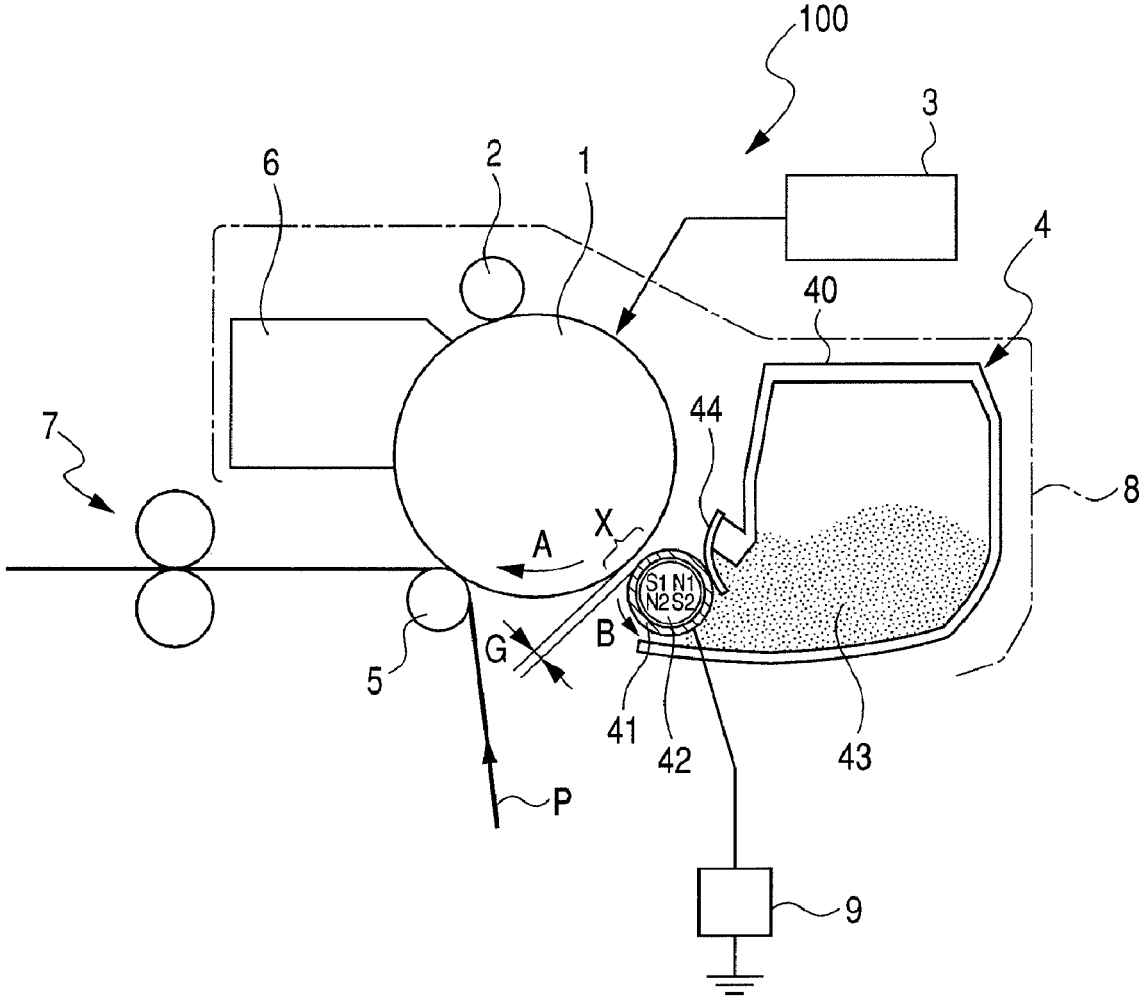
FIG. 1 is a schematic configuration diagram showing an embodiment of an image forming apparatus comprising a developing apparatus according to the present invention.

FIG. 1 is a schematic configuration diagram showing an embodiment of an image forming apparatus using a developing apparatus according to the present invention.

In the present embodiment, an image forming apparatus 100 is a laser beam printer of an electrophotographic printing method and comprises a drum-shaped electrophotographic photosensitive member, that is, a photosensitive drum 1 as an image bearing member. The photosensitive drum 1 includes a photoconductive layer such as an OPC or the like on the surface thereof and rotates in a direction indicated by the arrow A (clockwise direction) in the FIG. 1 by a drive system (not shown).

The photosensitive drum 1 is charged uniformly by a primary charger 2 as charging means, and then is irradiated by light in accordance with the image signal by an exposure device 3 to form an electrostatic latent image.

The electrostatic latent image on the photosensitive drum 1 is then developed by a developing apparatus 4, which contains a developer to form a toner image. In the present embodiment, a magnetic mono-component developer or a magnetic mono-component toner is used as the developer 43, and development is performed by a toner projection development. The configuration of the developing apparatus 4 will be described in greater detail hereinafter.

By applying a transfer bias to the transfer roller 5 as a transfer means, in a transfer position, the toner image visualized by the developing apparatus 4 is transferred onto a transfer material P, such as a transfer paper, as a recording medium conveyed from a paper feeding cassette (not shown).

The transfer material P is separated from the photosensitive drum 1. The developer is fixed by heating and pressurizing the transfer material P in a nip portion formed by a fixing roller and a pressure roller of the fixing device 7. And then, the transfer material P is discharged out of the image forming apparatus.

Note that, after passing through the transfer roller 5, the untransferred developer remaining on the surface of the photosensitive drum 1 is removed by a cleaning device 6 and collected by a recovery container (not shown).

(Developing Apparatus)

The developing apparatus 4 will be hereinafter described in greater detail.

The developing apparatus 4 comprises a developing container 40, in which a developing sleeve 41 that serves as a developer carrying member is rotatably arranged.

The developing apparatus 4 can be used as a cartridge detachably mountable to a main body of an image forming apparatus that comprises a photosensitive drum 1. Further, it can be detachably mountable to the main body of an image forming apparatus as a process cartridge 8 that is integrated together with at least the photosensitive drum 1. Furthermore, as shown in FIG. 1, even the primary charger 2 and the cleaning device 6 can be incorporated into the process cartridge 8.

The photosensitive drum 1 and the developing sleeve 41 of the developing apparatus 4 are provided with a predetermined gap (hereinafter referred to as a "SD gap") G therebetween and thus do not contact each other. The developing sleeve 41 rotates in a direction identical to the photosensitive drum 1 (a counter-clockwise direction indicated by the arrow B in FIG. 1) at an opposing portion (that is, developing portion) X.

Inside the developing sleeve 41 is arranged with a magnet roller 42 that is a magnetic field generating means (magnetic field generating member). The magnet roller 42 is arranged with a plurality of magnetic poles S1, S2, N1 and N2, whose magnetic forces attract the magnetic toner 43 in the developing container 40 so that the magnetic toner 43 is carried on the surface of the developing sleeve 41. The developing blade 44 that abuts the surface of the developing sleeve 41 regulates the carried magnetic toner 43 to make a toner layer of a uniform amount.

As described above, the surface of the photosensitive drum 1 and the surface of the developing sleeve 41 are disposed in opposed relation with each other having a predetermined gap therebetween. One of the magnetic poles of the magnet roller 42, which is an S1 pole in the present embodiment, is arranged in a way that the pole is substantially conformed to the nearest position of the surface of the photosensitive drum 1 and the surface of the developing sleeve 41. Between the photosensitive drum 1 and the developing sleeve 41, a developing bias, to be described later, is applied by a high voltage power supply 9 (FIG. 1) as a developing bias applying means. The potential of the electrostatic latent image and the electric field by the developing bias allows the magnetic toner 43 on the developing sleeve surface to fly and develop the electrostatic latent image formed on the photosensitive drum 1.

Figure 2:
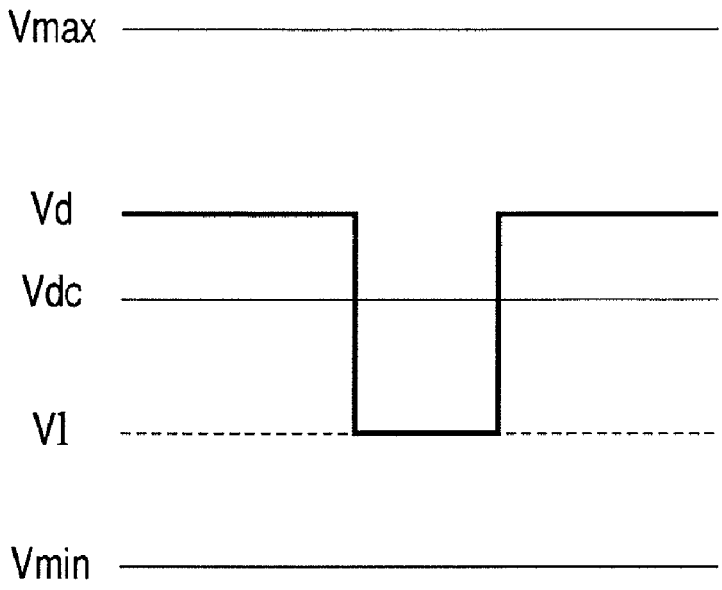
FIG. 2 is an explanatory diagram illustrating an embodiment of setting a latent image.

FIG. 2 shows a potential setting condition in the developing process of the present embodiment. It should be noted that the developing process of the present embodiment employs a reversal development system and the toner is charged with a negative polarity.

Figure 3:
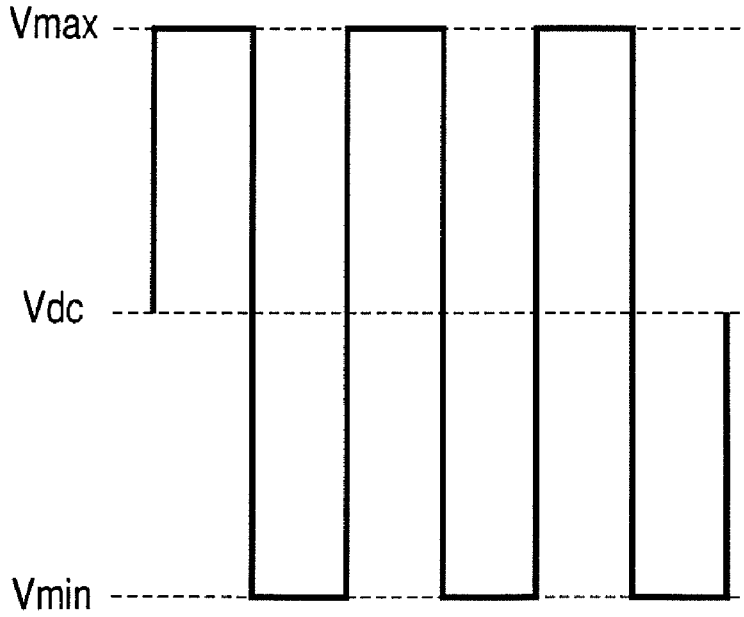
FIG. 3 is an explanatory diagram illustrating an embodiment of a developing bias.

In FIG. 2, the latent image potential on the photosensitive drum 1 is shown in which Vd is a charged potential in non-image area, and Vl is a charged potential (charged potential after image exposure) in the image area. The developing bias potential applied between the photosensitive drum 1 and the developing sleeve 41 is shown overlapped with the latent image potential. The developing bias is a DC bias, which has a 50% duty ratio of the rectangular wave alternation bias (Peak-to-Peak voltage: Vpp) superimposed on Vdc as shown in FIG. 3. In FIG. 2, the toner flight potential which allows the toner to fly from the developing sleeve to the photosensitive drum is represented by Vmax (=Vdc+Vpp/2), and the toner pullback potential which pulls back the toner from the photosensitive drum to the developing sleeve is represented by Vmin (=Vdc−Vpp/2), wherein the Vmax is a potential at an identical polarity side with the normal polarity of the toner with respect to Vd, while the Vmin is a potential at a reverse polarity side to the normal polarity of the toner with respect to Vl. The developing bias applied to the developing sleeve forms the alternate electric field between the developing sleeve and the photosensitive drum in both the potential Vd portion and the potential Vl portion of the photosensitive drum.

(Electric Field and the Magnetic Toner)

Figure 4:
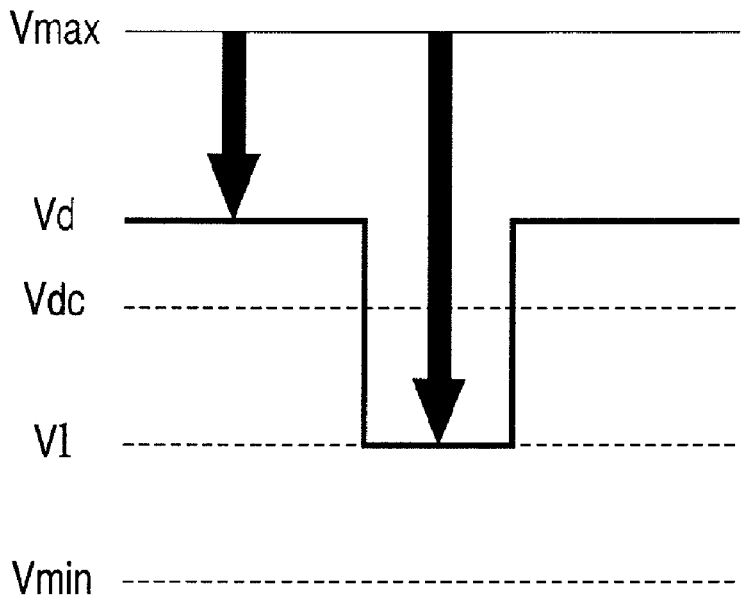
FIG. 4 is an explanatory diagram illustrating a behavior of a magnetic toner.
Figure 5:
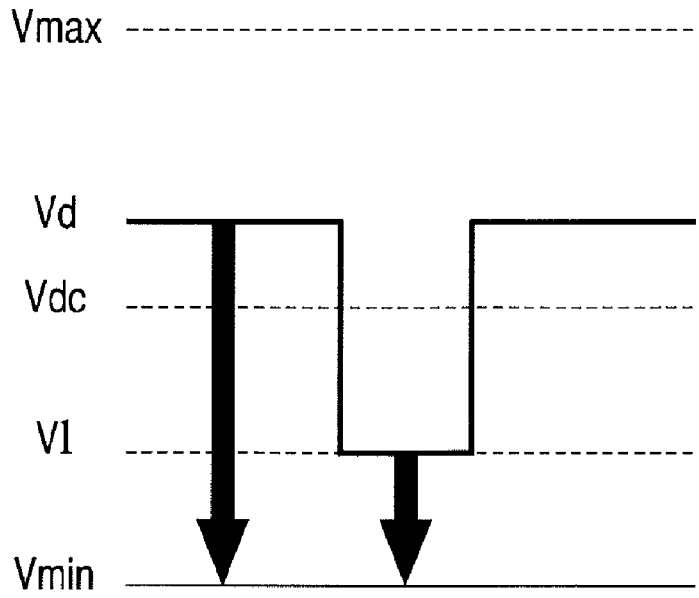
FIG. 5 is an explanatory diagram illustrating a behavior of a magnetic toner.
Figure 6:
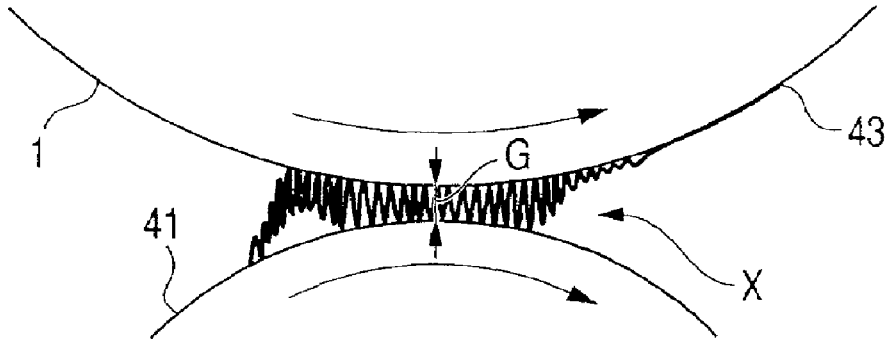
FIG. 6 is an explanatory diagram illustrating a behavior of a magnetic toner.

With reference to FIGS. 4 to 6, a behavior of the magnetic toner 43 caused by the electric field will be described hereinbelow.

FIG. 4 shows a moment upon which a bias is applied in a direction, in which the bias allows the magnetic toner 43 to fly in a direction from the developing sleeve 41 to the photosensitive drum 1. The developing sleeve 41 is applied with the toner flight potential Vmax and an electric field (flight electric field) is generated which has an intensity corresponding to the potential difference of each of the Vd and the Vl on the photosensitive drum 1 between the photosensitive drum 1 and the developing sleeve 41. The magnetic toner 43 on the developing sleeve 41 flies on the photosensitive drum 1 by an electric force that corresponds to the electric field and the charge of the toner owned by itself. In FIG. 4, since a greater force is applied to the Vl region, which has a larger potential difference between the Vl and the Vmax than that of the Vd region, the magnetic toner 43 that reaches onto the photosensitive drum 1 tends to gather in the Vl region.

FIG. 5 shows a moment upon which a bias is applied in a direction, in which the bias pulls the magnetic toner 43 back in a direction from the photosensitive drum 1 to the developing sleeve 41. The developing sleeve 41 is applied with the toner pullback potential Vmin and in the same manner as described above, an electric field (pullback electric field) is generated which has an intensity corresponding to the potential difference of each of the Vd and the Vl on the photosensitive drum 1 between the photosensitive drum 1 and the developing sleeve 41. In FIG. 5, the potential difference with respect to the Vmin is greater in the Vd region than in the Vl region, as opposed to the case shown in FIG. 4. Therefore, the magnetic toner 43 which flies onto the photosensitive drum 1 in the Vd region suffers a greater force than in the Vl region, and thus can more easily return onto the developing sleeve 41. Conversely, it is relatively difficult for the magnetic toner 43 in the Vl region to return onto the developing sleeve 41.

The magnetic toner 43 flies to and fro between the photosensitive drum 1 and the developing sleeve 41 in an alternating state shown in FIG. 4 and the state shown in FIG. 5. Since the photosensitive drum 1 and the developing sleeve 41 rotate in the same direction, the magnetic toner 43 moves conceptually by following a profile as shown in FIG. 6 (FIG. 6 shows the behavior of the single particle toner in the Vl region).

The behavior of the toner from the nearest position to a position downstream therefrom in a direction of the rotation will be described further in detail.

In the vicinity of the nearest position in which the photosensitive drum 1 and the developing sleeve 41 are separated by a narrow SD gap G, both the flight electric field and the pullback electric field are stronger and the magnetic toner 43 reciprocates between the photosensitive drum 1 and the developing sleeve 41. Both the flight electric field and the pullback electric field described above are gradually weakened as the SD gap widens.

As shown in FIGS. 4 and 5, since the pullback electric field is relatively smaller than the flight electric field in the Vl region, a part of the magnetic toner 43 flown to the Vl region cannot return onto the developing sleeve 41 at a certain point in time. The magnetic toner 43 that cannot return onto the developing sleeve fluctuates as if it jumps in the vicinity of the Vl region. However, when the SD gap G widens and the electric field is thus sufficiently weakened, it eventually remains on the photosensitive drum 1. The adhesive force of the magnetic toner 43 at a moment when the electric field has no influence is mainly the potential difference of |Vd−Vl| and a reflection force (an electric reflection force) of the photosensitive drum 1 due to the charge carried by the magnetic toner 43.

In the Vd region where the pullback electric field is greater than the flight electric field, the magnetic toner 43 that is pulled back onto the developing sleeve 41 cannot fly again onto the photosensitive drum 1. On the developing sleeve 41 that faces the Vd region, the magnetic toner 43 repeats jumping in order to reach the Vd region on the photosensitive drum 1. However, when the SD gap G is widened and the electric field is weakened, it eventually remains on the developing sleeve 41.

At the end of the above process, the magnetic toner 43 remains in the Vl region on the photosensitive drum 1, and most of the magnetic toner 43 in the Vd region is pulled back to develop the latent image.

(Magnetic Field and Magnetic Toner)

The influence that the magnetic field exerts upon the magnetic toner 43 will be described hereinbelow.

In the magnetic developing system, the magnetic force of the magnet roller 42 in the developing sleeve 41 substantially contributes to the aforementioned developing process. The developing pole (S1 pole) of the magnet roller 42, as described hereinabove, is arranged to almost conform to the nearest position of the surface of the photosensitive drum 1 and the surface of the developing sleeve 41, and exerts a magnetic force to the magnetic toner 43 that reciprocates.

The magnetic binding force applied by the magnet roller 42 on the magnetic toner 43 always acts to pull back the magnetic toner 43 around the developing sleeve 41 in a direction towards the developing sleeve 41 so that the less charged magnetic toner 43 (including a reversal toner which is reversely charged in polarity) cannot fly in the electric field. The magnetic binding force significantly reduces the fogged image caused by the reversal toner (hereinafter referred to as a "reversal fogged image") and the release of the magnetic toner 43 that has almost no charge within the apparatus. The magnetic binding force mentioned above is determined to be from a fraction of the electric attractive force to a fraction of several tenths of the electric attractive force in the developing bias electric field.

The particles of the magnetic toner 43 under the influence of the magnetic field attract each other due to its own magnetization and behaves as a collective "toner magnetic brush" that extends along the line of the magnetic force. The reciprocal flying of the magnetic toner 43 as shown in FIGS. 4 and 5 are mostly the reciprocally flying of the "toner magnetic brush".

The magnetic binding force applied by the magnet roller 42 on the magnetic toner 43 is expressed as $-\nabla(M \cdot H)$ wherein the magnetization of the toner is M and the external magnetic field by the magnetic roller 42 is H. Here, the symbol $\nabla$ indicates "nabla" as a vector differential operator (derivation) in the vector analysis. The magnetization M is a function of H, and $M=\mu H$ when the toner magnetic permeability is expressed as $\mu$ (note that the magnetic permeability $\mu$ itself is the function of H). The aforementioned magnetic binding force is expressed as $-\nabla(M \cdot H)=-2\mu(H \cdot \nabla)H$ when the change of the magnetic permeability $\mu$ is disregarded. Here, $(H \cdot \nabla)H$ is an index to express the spatial change in the intensity of the magnetic field, which is determined by the magnetic field generated by the magnet roller 42. From the equation described above, the magnetic binding force can be determined by the size of the magnetic permeability p of the toner and the change of the magnetic field $(H \cdot \nabla)H$. As will be understood from the equation of the magnetic binding force described above, the uniform magnetic field gives $(H \cdot \nabla)H=0$, even in the very strong magnetic field when no forces are applied to the magnetic toner 43. In other words, the magnetic binding force does not depend upon the intensity of the magnetic field itself.

In the magnet roller 42 arranged as in the present embodiment, the intensity of the magnetic field H does not change much on the cylindrical surface in the circumferential direction coaxial to the developing sleeve 41. However, the direction of the magnetic field H changes greatly. On the other hand, the intensity of the magnetic field H in the normal direction, when compared with the circumferential direction, is rapidly weakened as further separated from the surface of the developing sleeve 41. Therefore, the $(H \cdot \nabla)H$ will have a significantly greater normal directional component than the circumferential directional component, and as a result, the magnetic binding force applied to the "toner magnetic brush" acts so as to attract the brush to the nearest developing sleeve 41.

Alternatively, in the magnet roller 42 with a magnetic pole configuration according to the present embodiment, the normal directional component (the inclination of the magnetic field intensity in the normal direction) of the $(H \cdot \nabla)H$ does not change much in the vicinity on the surface of the developing sleeve 41, approximately 30 to 40 (T/m). Therefore, the size of the magnetic binding force that depends greatly on the $(H \cdot \nabla)H$ does not exhibit a great difference either on the photosensitive drum 1 or in the vicinity of the developing sleeve 41. A similar tendency can be observed when the magnetic pole configuration of the magnet roller 42 is identical regardless of the size of the diameter of the developing sleeve 41 or the size of the magnetic force in the developing pole.

On the other hand, the bonding force among the "toner magnetic brush" magnetic toner 43 is proportional to the square of the toner magnetization M. Unlike the magnetic binding force depending on the $(H \cdot \nabla)H$, the toner magnetization M depends greatly on the intensity itself of the magnetic field H. For this reason, the size and aggregation intensity of the "toner magnetic brush" is largely influenced by the intensity of the magnetic field H where the "toner magnetic brush" exists. For example, there is a great difference between the bonding force of the "toner magnetic brush" on the photosensitive drum 1 and the bonding force of the "toner magnetic brush" on the developing sleeve 41. As a matter of course, the bonding force of the "toner magnetic brush" is largely influenced by the characteristics of the magnetic permeability $\mu$ of the toner.

(The Flight State of the Magnetic Toner)

The flight state of the magnetic toner 43 in the developing process of the present embodiment will be classified in greater detail hereinafter in order to classify and define a region from the nearest position to a position downstream therefrom in the rotational direction that is associated with the image quality.

As mentioned above, the magnetic toner 43 reciprocally flies in the nearest position based on the applied developing bias and the latent image potential. As it moves downstream in the rotational direction, the magnetic toner 43 changes its behavior in different regions, which can be classified below as:

irrespective of whether it is the image region (aforementioned VI region) or the non-image region (aforementioned Vd region), (1) a region where there is a repeated collision on the surface of both the photosensitive drum 1 and the developing sleeve 41;

a region (2) where it is impossible to return to the developing sleeve 41 from the image region;

a region (3) where it is impossible to reach the non-image region from the developing sleeve 41;

a region (4) where it is impossible to return to the developing sleeve 41 from the non-image region;

a region (5) where it is impossible to reach the image region from the developing sleeve 41; and a region (6) in the image region where it is impossible for the magnetic toner 43 to jump (move).

In accordance with the setting of the potential of the latent image and the setting of the DC bias potential Vdc of the developing bias, the above regions (2) and (3) can be interchanged with regions (4) and (5).

In the abovementioned region (1), the magnetic toner 43 is supplied uniformly to the latent image on the photosensitive drum 1. This region is important for maintaining the density and referred to as a "reciprocal flight region".

The regions (2), (3), (4) and (5) are the most important regions in the developing process, and are referred to as a "visualizing area" which substantially visualizes the latent image, and remove the magnetic toner 43 from the unnecessary portion (non-image region) and cause the magnetic toner 43 to remain in the necessary portion (image region).

The abovementioned region (6) is a region in which fine latent image reproduction is conducted while the magnetic toner 43 is swung on the photosensitive drum 1. In this region, the bonding among the "toner magnetic brush" in the image region is relaxed to be broken, and the fogging toner remaining in the non-image region is rearranged to be attracted to the nearest image region. The region is referred to as a "toner rearranging region".

In the developing apparatus 4 according to the present embodiment, the magnetic toner 43 is carried on the developing sleeve 41, and then the photosensitive drum 1 is exposed to light and developing bias is applied without rotating the photosensitive drum 1 and the developing sleeve 41, and the magnetic toner 43 is attached on the photosensitive drum 1 in a portion corresponding to the abovementioned regions (1) to (5). This can be empirically performed easily and referred to as a "developing region".

In the aforementioned "toner rearranging region", the "toner magnetic brush" flies (or naps) due to the influence of the electric field, and lands or collides (or lodges) on the photosensitive drum 1 or the developing sleeve 41 to be broken by the impact thereof. The "toner magnetic brush" is then reorganized by the magnetic field H in the position of collision (or lodging), wherein the size of "toner magnetic brush" and the degree of the aggregation change depends on the intensity of the magnetic field H. As a matter of course, the collapse of the "toner magnetic brush" occurs favorably as the number of the landings and collisions (or lodging) increases. On the other hand, when the abovementioned "toner magnetic brush" does not swing but only attaches onto the photosensitive drum 1, the "toner magnetic brush" will not be collapsed much.

Japanese Patent Application Laid-open No. 2005-345618 and others suggest that the state of the "toner magnetic brush" on the photosensitive drum 1 in the final stage of the developing process greatly contributes the image quality. In short, it can be concluded that when the "toner magnetic brush" does not grow much and remains small (if possible, when it is collapsed to a level of the toner particulate element), it is superior in the latent image reproducibility.

Conversely, when the "toner magnetic brush" is not sufficiently collapsed and developed on the photosensitive drum 1 in a state of relatively larger aggregation, the elaborate latent image reproduction will be inhibited, and the lowered image quality will be conspicuous with respect to deterioration in the resolution or a lowered consistency in the half tone image. Further, the large "toner magnetic brush" attached on the non-image portion will become a fogged image that gives a bad visual impression more than a numerical value measured by an optical measuring device such as a reflected light meter. Furthermore, when the developing sleeve 41 is smaller in diameter, not only the "developing region" but also the "toner rearranging region" is made narrower, and the collapse of the "toner magnetic brush" will not be advanced. Synergistically with the decline in density followed by the narrowing of the "developing region", it is hard to obtain a high quality image.

(Magnetic Properties and Conditions of the Magnetic Toner)

Based on classification and consideration of the flight state of the magnetic toner 43, the inventors of the present invention found the magnetic properties and conditions of the magnetic toner 43 for maintaining excellent image quality in case where the developing sleeve 41 is made small in diameter.

In order to maintain an image density, it is preferred that the magnetic binding force in the "developing region" is small. However, the magnetic binding force in the magnetic toner 43 should be maintained to some degree higher than a certain amount in order to prevent the occurrence of the reversal fogged image or the release of the toner.

As described above, the magnetic binding force is determined by the size of the magnetic permeability p of the toner and changes in the magnetic field (H·∇) H. The magnetic permeability p of the toner is a function of the magnetic field H and determined by the types, the volume, and the state of the dispersion of individual magnetic particle contained in the magnetic toner 43. In order to obtain a desirable magnetic binding force, the size of the magnetization M(=μH) of the magnetic toner 43 should be defined by the intensity that is close to the intensity of the magnetic field H applied to the actual "developing region".

In the magnetic toner projection development process to which the present invention belongs, the magnetic flux density of the "developing region" is typically used in a range from 65 mT to 120 mT. Too small a magnetic flux density mentioned above (smaller than 65 mT) cannot be used because sufficient magnetic force to return the magnetic toner 43 onto the developing sleeve 41 is not obtained, and hence, the releasing level of the particle in the apparatus and the like deteriorates. On the other hand, when the abovementioned magnetic flux density is too large (larger than 120 mT), the electric field that allows the magnetic toner 43 to fly exceeds the leak limit (threshold value of the aerial discharge). In practice, in order to have a larger magnetic flux density, a material with high retention or some specific configuration of bonded materials should be selected as a magnetic body of the magnet roller 42. However, the cost of such material or configuration is high and provides few advantages. For this reason, in most of the magnetic toner projection development processes, a magnet roller 42 that has a magnetic flux density of a level that can restrain the deterioration of the particle release in the apparatus (which is a level between 65 mT and 120 mT as mentioned above) is selected appropriately.

In view of the above, the present invention defines the saturation magnetization as of the magnetic toner 43 at 1000 oersteds (79.6 kA/m) that corresponds to 100 mT of the magnetic flux density.

Even with a smaller diameter, in order to maintain or improve the reproducibility of the latent image, the "toner magnetic brush" should be effectively collapsed even in a narrow "toner rearranging region". The inventors of the present invention have predicted that the "toner magnetic brush" can be effectively decomposed in the case where the toner has such a magnetic property that the bonding force of the reconfiguration of a "toner magnetic brush", which has once collapsed by the impact of the landing (lodging), can be smaller than the attenuation of the intensity of the magnetic field H. The bonding force is proportional to the square of the toner magnetization M(=μH). Accordingly, within a range of the intensity of the magnetic field H corresponding to the actual "toner rearranging region", if the magnetic toner 43 has such a magnetic property that the attenuation of the magnetization M is greater than the attenuation of the intensity of the magnetic field H, the bonding force of the "toner magnetic brush" will be made weaker.

Figure 7:
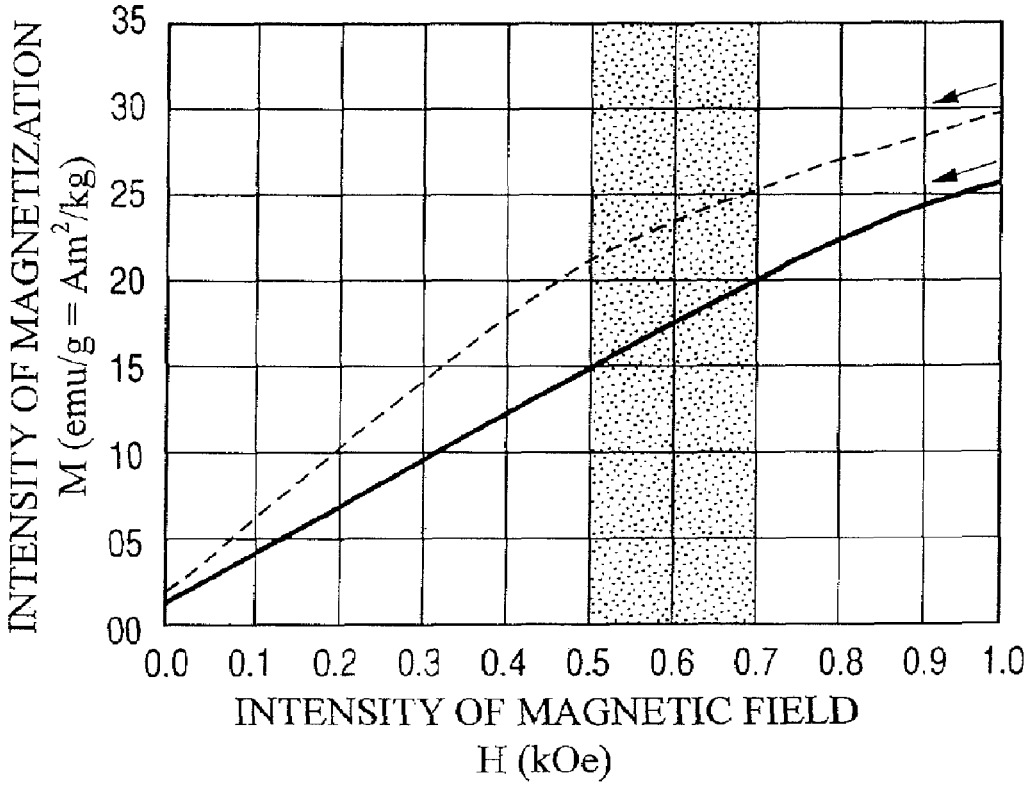
FIG. 7 is an explanatory diagram illustrating a magnetic property of a magnetic toner.

The solid line in FIG. 7 shows a typical hysteretic characteristic of the magnetic toner 43 of the present invention. The measuring method will be described later in greater detail. In FIG. 7, the broken line shows a typical hysteretic characteristic of the conventional magnetic toner. In FIG. 7, the arrow shows a profile in the case where the intensity is reduced from the magnetic field of 1000 oersteds.

In the magnetic toner projection development method to which the present invention belongs, the magnetic flux density of the "toner rearranging region" is typically within a range of approximately 50 mT to 70 mT. Accordingly, it is desirable that the magnetization M in the hysteresis curve of FIG. 7 has a greater inclination in a range from 500 oersteds, corresponding to 50 mT of the magnetic flux density to 700 oersteds, corresponding to 70 mT of the magnetic flux density. The magnetic powder of the ferromagnetic material contained in the toner typically has saturation magnetization properties in which the inclination of the magnetization M is smaller in the region where the intensity of the magnetic field H is greater than in the region where the intensity of the magnetic field H is smaller. As shown in the broken line in FIG. 7, in the one with no attenuation of the magnetization M and bulging at a greater side within a range of 700 oersteds to 500 oersteds, the bonding force does not change much and collapse of the "toner magnetic brush" does not advance much. The magnetic toner 43 according to the present invention shown in solid line in FIG. 7 has only a few changes in the inclination of the magnetization M and has a profile proportional to the intensity of the magnetic field H, and the magnetization M attenuates particularly in a range of 700 oersteds to 500 oersteds. Here, as for the ratio of the intensity of the magnetization at 500 oersteds with respect to that at 700 oersteds, the smaller ratio is the better.

From above, the magnetization M at 700 oersteds and 500 oersteds should be defined as a magnetic property of the magnetic toner 43. However, he already defined saturation magnetization σs at 1000 oersteds and the magnetization M to be defined are not independent. The present invention, therefore, defines by the ratio of the magnetization M at 700 oersteds and 500 oersteds to the saturation magnetization σs with the saturation magnetization σs at 1000 oersteds as a reference.

Figure 8:
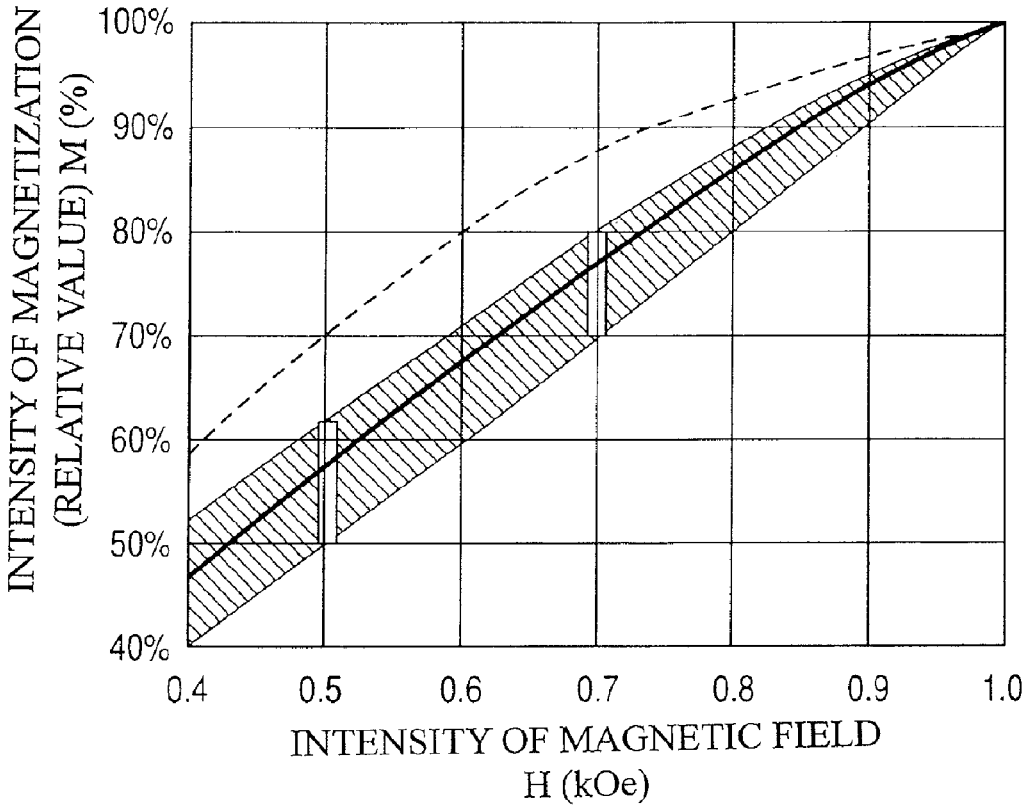
FIG. 8 is an explanatory diagram illustrating a magnetic property of a magnetic toner.

The hysteresis curve of the toner shown in FIG. 7 is shown with a relative ratio of the magnetization M that is standardized with the saturation magnetization σs at 1000 oersteds as 1 in FIG. 8.

In the embodiment and the Comparative Example that will be described later, the toner which comprises the magnetic toner 43 of the present invention that is shown in the solid line in FIG. 8 and shows a profile that is in a hatched region, can be preferably used in the developing apparatus of which developing sleeve 41 has a small diameter. Note that the magnetic toner 43 defined in the present invention may have a profile in the abovementioned hatching region within a range from 700 oersteds to 500 oersteds in FIG. 8, and may also be out of the hatching region in the range other than the above. Conversely, a toner that shows a profile out of the abovementioned hatching region although in a range from 700 oersteds to 500 oersteds is a toner that the collapse of the "toner magnetic brush" is difficult to advance, which is not preferable for the developing apparatus that is small in diameter. The lower limit of the abovementioned hatching region is constituted of a line that connects the saturation magnetization σs at 1000 oersteds and a point of origin (a line completely proportional to the intensity of the magnetic field H). There are typically no ferromagnetic materials that have physical properties below this line.

(Degree of Circularity of Magnetic Toner)

Figure 9A:
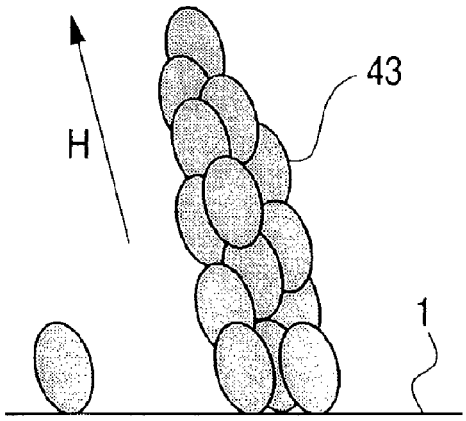
FIGS. 9A and 9B are illustrating diagrams each showing an influence of the shape of a magnetic toner.
Figure 9B:
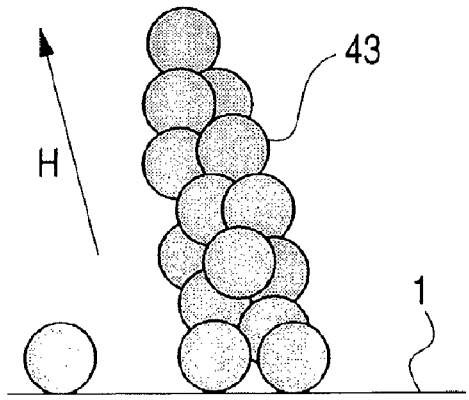

Easiness of "toner magnetic brush" collapsing strongly depends on the degree of sphericity (the degree of circularity) of the magnetic toner 43. For the magnetic toner, which is not spherical, the direction of the magnetization tends to align along the major axis in which the magnetic moment becomes the largest. In the case where a large number of magnetic toners, which are not spherical, are aggregated in the external magnetic field, they will be the "toner magnetic brush" which are densely aggregated with their axis in a direction of the magnetic field H and thus hardly be collapsed. On the other hand, since the magnetic toner 43 whose shape is close to spherical hardly has a magnetic anisotropy with respect to the shape, it may form a "toner magnetic brush" of a lower aggregation level as in FIG. 9B rather than in FIG. 9A and can easily be collapsed.

When the magnetic toner is collapsed to a level of an individual toner particle, the magnetic toner having a more highly spherical shape can more easily rotate. For this, it can be assumed that when the magnetic toner is swung by the electric field in the "toner rearranging region", it can be relatively easily moved on the photosensitive drum 1. In particular, it can also be assumed that when the magnetic toner can be influenced by the potential difference between the image region and the non-image region on the photosensitive drum 1, the magnetic toner attached on the non-image region as the fogging toner can be attracted to the image region with a greater force when the shape is more highly spherical.

In the case of the magnetic toner having the aforementioned magnetic properties but not having a highly spherical shape, the latent image reproducibility will not highly improve. It can be assumed that in the magnetic toner 43 having magnetic properties of the present embodiment and a degree of circularity of 0.960 or higher, the "toner magnetic brush" is collapsed to a level of the toner aggregation body with a small number of toner particles or a larger number of single toner particles are present, so that they can be easily moved or rearranged on the photosensitive drum 1.

(Manufacturing Method of Magnetic Toner)

The magnetic toner 43 according to the present invention may be manufactured by any of the known methods.

Manufacturing method by grinding will be described below.

First, a binder resin, a magnetic powder, a mold releasing agent, a charge control agent and the like are sufficiently mixed by a mixer; the mixed agents are fused and kneaded by using a heat kneader to prepare a mutually soluble resin base material. Components necessary for the magnetic toner 43, such as a coloring agent or other additives, may be added where necessary. The abovementioned mixer may include Henschel Mixer, a ball mill, or the like. The heat kneader may include a heat roll kneader, an extruder, or the like.

In the abovementioned resin base material, other magnetic toner materials such as magnetic powder or the like are dispersed or fused, the resultant material is cooled to be hardened and ground, then classified and surface treated to obtain toner particles. The order of the classification process and the surface treatment process can be interchanged. In the classification process, it is preferable to use a multiple classification apparatus in view of the production efficiency.

The grinding process includes the use of a known grinder, such as a mechanical impact type grinder, a jet type grinder and the like. It is desirable that in order to obtain a toner with a particular degree of circularity (0.950 or higher), further processes of grinding with heating, a process of adding auxiliary mechanical impact, or the like should be performed. Alternatively, a process of dispersing the finely ground toner particles in hot water (water bath process), or a process of passing in hot air, or the like may be performed.

The means for applying mechanical impact in the abovementioned grinding process includes the use of the mechanical impact type grinders, for example, the Kryptron system manufactured by Kawasaki Heavy Industries, Ltd., or Turbo Mill manufactured by Turbo Kogyo Co., Ltd., and the like. Alternatively, the means for applying mechanical impact on a toner by a high-speed rotation blade includes the Mechano-Fusion system manufactured by Hosokawa Micron Corporation, or the hybridization system manufactured by Nara Machinery Co., Ltd., and the like. In the case where the means for applying mechanical impact is employed, it is preferable that the process temperature is set around a temperature of the glass transition point (Tg) of the toner and the temperature thereabout (Tg±10° C.) in view of the prevention of the aggregation and improved productivity.

The binding resin for manufacturing the toner by a grinding process according to the present invention includes a homopolymer of styrene such as polystyrene, polyvinyl toluene, and the like and the substitution product; a styrene-based copolymer such as styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-octylacrylate copolymer, styrene-dimethylaminoethylacrylate copolymer, styrene-methylmethacrylate copolymer, styrene-ethylmethacrylate copolymer, styrene-butylmethacrylate copolymer, styrene-dimethylaminoethylmethacrylate copolymer, styrene-vinylmethylether copolymer, styrene-vinylethylether copolymer, styrene-vinylmethylketone copolymer, styrene-butadiene copolymer, styrene-isoprene copolymer, styrene-maleic acid copolymer, and styrene-maleate copolymer; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, denatured rosin, terpene resin, phenol resin, aliphatic or alicyclic hydrocarbon resin, aromatic hydrocarbon resin, paraffin wax, and carnauba wax, or in combination thereof. Of these, styrene-based copolymers and polyester resins are particularly preferred in view of developing properties, fixing property, and the like.

As described above, in manufacturing the magnetic toner 43 of a high degree of circularity via a grinding process, some particular treatments, such as by using a machine, applying heat or by other means, should be performed in order to improve the degree of circularity of the toner particles.

On the other hand, a chemical granulating system that manufactures the toner in the wet medium including a dispersion polymerization process, an association agglutination method, a suspension polymerization process and the like allows the direct formation of the magnetic toner 43 with high circularity and superior in the productivity and the configurative properties. The suspension polymerization process, in particular, can easily satisfy the conditions desired for the present invention.

Manufacturing by the suspension polymerization system will be described hereinbelow.

First, a polymerizable monomer and a colorant (and further, a polymerization initiator, a cross-linking agent, a charge control agent, and other additives when necessary) are uniformly dissolved or dispersed to form a polymerizable monomer composition. The polymerizable monomer composition is dispersed in a continuous layer (such as an aqueous phase) containing a dispersion stabilizing agent by using a proper stirrer for dispersion. At the same time, a polymerization reaction is performed to obtain a toner having a desirable particle diameter.

The polymerizable monomers that forms the abovementioned polymerizable monomer composition includes: styrene monomers such as styrene, -methylstyrene, m-methylstyrene, p-methylstyrene, -methoxystyrene, and p-ethylstyrene; acrylates such as methylacrylate, ethylacrylate, n-butylacrylate, isobutylacrylate, n-propylacrylate, n-octylacrylate, dodecylacrylate, 2-ethylhexylacrylate, stearylacrylate, 2-chloroethylacrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate, and others such as acrylonitrile, methacrylonitrile, and acrylamide. These monomers can be used alone or in a mixture thereof. Among such monomers, it is preferable that styrene or styrene derivatives are used alone or in a mixture thereof in view of the developing property and the durability of the toner.

In the abovementioned polymerizable monomer composition, resins may be added for the polymerization. However, polymerizable monomer component containing a hydrophilic functional group for example, an amino group, a carboxylic acid group, a hydroxyl group, a sulfonic group, a glycidyl group, and a nitrile group cannot be used since they are water-soluble and dissolved in aqueous suspensions to cause emulsion polymerization. When these polymerizable monomer components are demanded to introduce into the toner, the polymerizable monomer component should be in a form of copolymers with styrene or vinyl compound such as ethylene, in random copolymers, block copolymers, or graft copolymers. Alternatively, condensation polymerization such as polyester, polyamide, and the like, or addition polymerization such as polyether, polyimine and the like may be used. When such high molecular weight polymers including a polarity functional group co-exist in the toner, the aforementioned wax components are phase separated and a stronger internal capsule is achieved, providing further blocking resistance property and an excellent developing property to the toner.

The magnetic powder is dispersed in the polymerizable monomer composition as one of the abovementioned colorant. However, since the magnetic powder typically has a poor dispersion property and a strong interaction with water, which is a dispersion medium, it has been difficult to provide toner that has a desired degree of circularity and particle size distribution. For this reason, the hydrophilia on the surface of the magnetic powder has been modified and a hydrophobic treatment has been performed by applying a coupling agent. It is preferred during the hydrophobic treatment of the surface of the magnetic powder, the magnetic powder is dispersed in an aqueous medium so that the powder is formed to be a primary particle diameter, and the surface treatment is performed while the coupling agent is hydrolyzed. Further, it is extremely preferred that the manufactured magnetic body is washed in the aqueous solution and then the hydrophobic treatment is performed without drying the magnetic body.

The coupling agent that can be used in the surface treatment of the magnetic powder includes, for example, a silane coupling agent, a titanium coupling agent, and the like. The more preferably used is the silane coupling agent shown in the general formula:

$$RmSiYn,$$

wherein R is an alkoxy group, m is an integer of 1 to 3, Y is a hydrocarbon radical, such as an alkyl group, a vinyl group, a glycidoxy group, a methacryl group and the like, and n is an integer of 1 to 3, and wherein m+n=4.

The silane coupling agent expressed in the abovementioned general formula includes, for example, vinyl trimethoxysilane, vinyl triethoxysilane, tris-(β-methoxyethoxy)silane, β-(3,4epoxycyclohexyl) ethyltrimethoxysilane, γ-glycidoxypropyltrimethoxysilane, γ-glycidoxy propylmethyldiethoxysilane, γ-aminopropyltriethoxysilane, N-phenyl-γ-amino propyltrimethoxysilane, γ-methacryloxypropyltrimethoxysilane, vinyl triacetoxysilane, methyl trimethoxysilane, dimethyl dimethoxysilane, phenyl trimethoxysilane, diphenyl dimethoxysilane, methyl triethoxysilane, dimethyl diethoxysilane, phenyl triethoxysilane, diphenyl diethoxysilane, n-butyl trimethoxysilane, isobutyl trimethoxysilane, trimethyl methoxysilane, n-hexyl trimethoxysilane, n-decyl trimethoxysilane, hydroxypropyl trimethoxysilane, n-hexadecyl trimethoxysilane, and n-octadecyl trimethoxysilane.

Among these, in particular, it is preferable in order to obtain a sufficient hydrophobic property to use an alkyltrialkoxysilane coupling agent shown in the formula below.

CpH2p+1-Si—(OCqH2q+1) 3, wherein p is an integer of 2 to 20 and q is an integer of 1 to 3.

The amount of the treatment with respect to 100 parts by mass of the magnetic powder is 0.05 to 20 parts by mass of the total amount of the silane coupling agent, or preferably, 0.1 to 10 parts by mass. It is further preferable that the amount of the treatment is adjusted according to the surface area of the magnetic powder, the reactivity of the coupling agent, and the like.

Irrespective of whether the process is conducted by a grinding or by a chemical granulation, the magnetic powders, used in the magnetic toner 43 have ferric oxide such as 4-3 magnetite, gamma-ferric oxide as a main component, and may include elements such as phosphor, cobalt, nickel, copper, magnesium, manganese, aluminum, silicon, and the like. These magnetic powders have a BET ratio surface area by a nitrogen adsorption method of, preferably, 2 $m^2/g$ to 30 $m^2/g$, and more preferably, 3 $m^2/g$ to 28 $m^2/g$. It is also preferable that the Mohs hardness is in a range of 5 to 7. As the shape of magnetic powder, there are a polyhedron, an octahedron, a hexahedron, a sphere, a needle-like shape, flaky shapes and the like. Among these, the shapes with less anisotropy such as a polyhedron, an octahedron, a hexahedron, a sphere and the like is preferable in view of the increased image density. Note that the shape of the magnetic powder should be confirmed by the SEM or the TEM, and when there is a distribution of the shape, the largest number of particles having that shape should be determined as the shape of the magnetic powder concerned.

It is preferable that the magnetic powder has a volume average particle size of 0.05 to 0.40 μm. When the volume average particle size is less than 0.05 μm, as the surface area of the magnetic powder is increased, the residual magnetization of the magnetic powder is increased, and as a result, the residual magnetization of the toner is increased as well, which is not preferable. On the other hand, when the volume average particle size exceeds 0.40 μm, although the residual magnetization is reduced, the dispersion of the magnetic powder uniformly on each of the toner particles will be difficult and thus the dispersibility is reduced, which is not preferable.

The volume average particle size of the magnetic powder can be measured by using a transmission electron microscope (TEM). Specifically, the transmission electron microscope is used to measure the diameter of 100 magnetic powder particles in a visual field using a photograph magnified by 10,000 to 40,000 times. The sample is prepared by sufficiently dispersing the toner particle to be observed into an epoxy resin, and then cured for two days in the atmosphere at a temperature of 40° C.; the resulting cured material is sliced by a microtome. After that, based upon an equivalent diameter of a circle that has an equal projected area as the magnetic powder, a volume average particle size was calculated. In addition, the particle size can also be measured by an image analyzer.

It is preferable that 10 to 200 parts by mass of the magnetic powder with respect to 100 parts by mass of the binding resin is used in the magnetic toner 43 in the present invention. It is further preferable that 20 to 180 parts by mass of the binding resin is used. When the amount of the binding resin is less than 10 parts by mass, the toner exhibits a poor tinting strength and if the amount of the binding resin exceeds 200 parts by mass, the dispersion of the magnetic powder uniformly on each of the toner particles will be difficult and the residual magnetization per toner particle will be unfavorably increased.

The content of the magnetic powder in the toner can be measured by using a thermo analyzer :TGA 7 manufactured by Perkin-Elmer Corp. In the measuring method, the toner is heated to a temperature of 900° C. from room temperature under a nitrogen atmosphere at a rate of the temperature increase of 25° C. per minute, here, the reduced percent by mass of a temperature between 100 to 750° C. is determined as a binding resin amount and the remaining weight is approximately determined as a magnetic powder amount.

(Method of Measurement)

A method of measuring each of the physical properties in accordance with the present invention will be described hereinafter.

Average Degree of Circularity

The present invention uses an average degree of circularity as an easy method for describing the shape of a particle in a quantitative manner. In the present invention, the flow type particle image analyzer "FPIA-1000" manufactured by TOA MEDICAL ELECTRONICS Corporation is used for the measurement, in which particle groups having an equivalent diameter of 3 μm or more are measured and each degree of circularity of the measured particles (Ci) is calculated by using the below mentioned formula (1). Further, as shown in the below formula (2), the total sum of the degree of circularity of the entire particles measured is divided by the total number of the entire particles (m) and is defined as an average degree of circularity (C).

Degree of Circularity (Ci)=(The perimeter of a circle having a projected area identical with the particle image)/(The perimeter of projected image of the particle) [Formula (1)]

$$\text{Average Degree of Circularity } (C) = \sum_{i=1}^{m} Ci/m \quad \text{[Formula (2)]}$$

The measuring apparatus "FPIA-1000" used in the present invention employs the below calculation. That is, the degree of circularity of each of the particles is calculated. And with respect to the calculation of the average degree of circularity and the mode degree of circularity, the particle is classified by the obtained degree of circularity into 61 divided classes of the degree of circularity of 0.40 to 1.00 by every 0.01. The central value of the division point and the frequency is used to calculate the average degree of circularity. The average degree of circularity calculated by this calculation method is somewhat different from the value of the aforementioned calculate system (2) in which the total sum of the degree of circularity of each of the particles is calculated. However, the error between the value of the average degree of circularity and the mode degree of circularity calculated and the value given by the formula (2) are so small that they can be substantially negligible. For this reason, the present invention adopted this calculation method. Although these statistical methods are different, the conceptions of both calculation formulas are equal. The measuring process is shown as follows.

Approximately 0.1 mg of the surface active agent is dissolved in 10 ml of water. Approximately 5 mg of the magnetic toner 43 is dispersed to prepare a fluid dispersion. Then, an ultrasonic wave (20 kHz, 50 W) irradiates the fluid dispersion for 5 minutes to adjust the fluid dispersion density at 5000 to 20,000/μl. The aforementioned measurement apparatus is used to obtain the average degree of circularity from a particle group having an approximate equivalent diameter of 3 μm or greater.

The average degree of circularity according to the present invention shows a distortion index of the projected image of the magnetic toner 43 from a perfect circular shape. The index is such that the average degree of circularity shows 1.000 when the magnetic toner 43 is in a perfect circular shape, and when the surface of the magnetic toner 43 has more complex shape, the average degree of circularity shows a smaller value.

The reason for measuring the degree of circularity of the particle group which constitutes a group of particles having a diameter of 3 μm or greater is that the influence of a group of particles having a diameter of less than 3 μm has extraneous additives that exist independently from the toner particle. The influence of this should be eliminated in order to obtain more precise circularity of the toner particle.

(2) Magnetic Properties

In the present invention, the saturation magnetization as and the hysteresis curve of the magnetic toner 43 are measured by using a vibration type magnetometer VSM P-1-10 (Manufactured by Toei Industry Co., Ltd). The saturation magnetization σs is measured by applying an external magnetic field of the intensity of 79.6 kA/m (1000 oersteds) at a room temperature of 25° C. The intensity of the external magnetic field is gradually lowered until it reaches zero and the hysteresis curve is recorded. The intensity of the external magnetic field applied was set at 79.6 kA/m (1000 oersteds). This value was selected as a reference value because the magnetic field intensity typically used in the magnetic toner projection development method on the developing sleeve 41 is often around 1000 oersteds.

From the abovementioned hysteresis curve, the magnetization values of the magnetic toner 43 having the external magnetic field of 55.7 kA/m (700 oersteds) and 39.8 kA/m (500 oersteds) are read out.

(3) Average Particle Size and Particle Size Distribution

For measurement of the average particle size and the particle size distribution of the toner, COULTER Multisizer (manufactured by COULTER Inc.) was used. For the electrolytic solution, ISOTON R-II (manufactured by Coulter Scientific Japan Co.) was used and primary sodium chloride is used to prepare 1% NaCl aqueous solution.

For a measuring method, in 100 ml to 150 ml of the aforementioned electrolysis aqueous solution, 0.1 ml to 5 ml of the surface active agent as a dispersing agent, preferably, alkylbenzene sulfonate is added. Further, 2 mg to 20 mg of a measuring sample is added. The sample was suspended in an electrolytic solution, to which the dispersion treatment was performed for about one to three minutes in an ultrasonic wave dispersing apparatus. The aforementioned COULTER Multisizer and a 100 μm aperture are used. The number of the toner particles of 2 μm or larger is measured. The number distribution is calculated to determine the number average particle size (D).

(4) The Magnetic Field Intensity Distribution Near the Developing Pole

The magnetic field intensity from the developing sleeve 41 to the photosensitive drum 1 is measured by a polar coordinate with the rotation center of the developing sleeve 41 as a point of origin and the nearest position of the developing sleeve 41 and the photosensitive drum 1 as a reference. The measuring apparatus used was a gauss meter (manufactured by F. W. Bell Inc.).

A jig is prepared which allows the magnet 42, that is a magnetic field generating means, to be rotated at a shaft that overlaps with the rotation center of the developing sleeve 41. A probe of the gauss meter is fixedly mounted to a predetermined normal directional distance (for example, a point that overlaps the outer diameter of the developing sleeves 41=a position spaced from a point of origin by "outer diameter/2"). The position corresponding to the nearest position of the developing sleeve 41 and the photosensitive drum 1 is set as an angle datum (0 degree). The magnet 3 on the jig is rotated for every predetermined angle and records the value shown on the gauss meter.

The normal directional component of the magnetic field is measured with the direction of the probe directed toward the point of origin (rotation center). The tangential direction component of the magnetic field is measured with the direction of the probe directed at a right angle with respect to the normal line (that passes the point of origin). From the abovementioned normal directional component and the tangential direction component of the magnetic field, the intensity and the direction of the magnetic field in the measuring point are determined.

(The Manufacturing Examples and Embodiments)

Hereinafter, the present invention will be described more specifically by referring to manufacturing examples and embodiments. Note that the numbers of the part of the compounds below denote parts by mass.

<1> Manufacturing of Magnetic Powder

<Manufacturing of Surface Treatment Magnetic Powder 1>

In the aqueous solution of the ferrous sulfate, a 1.0 to 1.1 equivalent of caustic soda solution to an iron element, a 1.5 percent by mass of hexametaphosphate soda in conversion of phosphorus element to an iron element, and a 1.5 percent by mass of hydrated silica soda in conversion of silicon element to an iron element were mixed to prepare an aqueous solution containing iron hydroxide.

While maintained in a pH of 9, the resultant aqueous solution was blown with air, and oxidized at 80 to 90° C. to prepare a slurry that generates a seed crystal.

In this slurry, a ferrous sulfate aqueous solution was added so that the amount of alkali contained in the beginning (the component of sodium in the caustic soda) will be 0.9 to 1.2 equivalent amounts. The slurry was maintained at a pH of 8 and air was blown in for further oxidization. Then the slurry containing magnetic ferric oxide was obtained. The resultant slurry was filtered and washed, and the hydrous slurry was once removed. At this time, a small amount of the sample was taken to measure the water contained therein. Next, the hydrous sample was dispersed again in another aqueous medium without drying. The pH of the re-dispersing fluid was made to have a pH of approximately 4.5. While the fluid was fully stirred, 1.6 parts by mass (the amount of the magnetic ferric oxide was measured as a value that withdraw hydrous amount from the hydrous sample) of the n-hexyltrimethoxy silane coupling agent was added to the magnetic ferric oxide to start hydrolytic degradation. After that, the pH of the fluid dispersion was set approximately at 10 to perform a condensation reaction for the coupling treatment. The generated hydrophobic magnetic powder was washed, filtered, and dried in a conventional manner. The particle was fully ground to obtain a spherical surface treatment magnetic powder 1 having a volume average particle size of 0.18 μm. The physical properties of the resulted surface treatment magnetic powder 1 are shown in Table 1. In the table, the residual magnetization or of the magnetic member was a measured value in which the external magnetic field was 79.6 kA/m (1000 oersteds).

<Manufacturing of the Surface Treatment Magnetic Powders 2 and 3>

In the manufacturing of the surface treatment magnetic powder 1, each of the magnetite particles having a different particle size was manufactured while varying the reaction conditions. The physical properties of the surface treatment magnetic powders 2 and 3 are shown in Table 1.

<Manufacturing of the Surface Treatment Magnetic Powders 4, 5 and 6>

In the manufacturing of the surface treatment magnetic powder 1, the pH during reaction and the reaction conditions were varied. The physical properties of the resultant surface treatment magnetic powders 4, 5 and 6 are shown in Table 1.

TABLE 1

| | Treatment agent/ additive amount | Particle diameter (μm) | σr ($Am^2/kg$) |
|---|---|---|---|
| surface treatment magnetic powder 1 | n-hexyltrimethoxy silane 1.6 | 0.24 | 2.4 |
| surface treatment magnetic powder 2 | n-hexyltrimethoxy silane 2.0 | 0.18 | 3.3 |
| surface treatment magnetic powder 3 | n-hexyltrimethoxy silane 2.4 | 0.14 | 4.0 |
| surface treatment magnetic powder 4 | n-hexyltrimethoxy silane 2.0 | 0.18 | 5.0 |
| surface treatment magnetic powder 5 | n-hexyltrimethoxy silane 2.4 | 0.14 | 5.2 |
| surface treatment magnetic powder 6 | n-hexyltrimethoxy silane 2.8 | 0.14 | 6.1 |

<2> Manufacturing of the Charge Control Resin 250 parts of methanol, 150 parts of 2-butanone and 100 parts of 2-propanol as a solvent medium, and 83 parts of styrene, 12 parts of 2-ethylhexylacrylate, 4 parts of 2-acrylamide 2-methylpropanesulfonic acid as a monomer were added into a reaction vessel, stirred, and heated to a point of the reflux temperature. The solution in which 0.45 part of t-butylperoxide-2-ethylhexanoate, which is a polymerization initiator, was diluted by 20 parts of 2-butanone, was dripped for 30 minutes by a dripper and kept stirring for 5 hours, and then, the solution in which 0.28 part of t-butylperoxide-2-ethylhexanoate was diluted by 20 parts of 2-butanone was dripped for 30 minutes and stirred for another 5 hours to complete the polymerization. The polymerization body that was obtained after the removal of the solvent medium under a reduced pressure was roughly ground to the extent of about 100 μm by a milling cutter attached with a 150-mesh screen and the charge control resin 1 was obtained. The average molar weight per number of the charge control resin was 8000, the average molar weight per weight was 26000, and the glass transition temperature (Tg) was 76° C.

<3> Manufacturing of the Magnetic Toner

<Manufacturing of the Magnetic Toner (1)>

Into 720 parts by mass of ion exchanged water, 450 parts by mass of 0.1 mol/1-$Na_3PO_4$ aqueous solution was introduced and heated to 60° C., and 67.7 parts by mass of 1.0 mol/1-$CaCl_2$ aqueous solution was added to obtain an aqueous medium containing disperse stabilizing agent.

83 parts by mass of styrene 0.17 parts by mass of n-butylacrylate 0.3 parts by mass of saturated polyester resin (Mn=10000, Mw/Mn=2.6, acid value=12 mg KOH/g, Tg=72° C.)

1 part by mass of charge control resin 1

90 parts by mass of surface treatment magnetic powder 1

The above mentioned formulation was uniformly dispersed and mixed by using Attritor (Mitsui Miike Kakoki K. K.). The monomer composition was heated to 60° C., 10 parts by mass of ester wax (with the maximum DSC endothermic peak of 72° C.) was added, mixed, and dissolved. 5 parts by mass of polymerization initiator 2,2'-azobis-(2,4-dimethyl valeronitrile) was dissolved.

In the aforementioned aqueous medium, the above polymerizable monomer composition was introduced and left under N2 atmosphere at 60° C. and stirred by a TK formula homomixer (Tokushu Kika Kogyo Co., Ltd.) at 10,000 rpm for 15 minutes and granulated. After that, the resultant product was stirred by a paddle stirrer and reacted for 8 hours at 80° C. After reaction, the suspension was cooled, the hydrochloric acid was added and the dispersing agent was dissolved at pH=2 or lower, then dissolved, filtered, water washed, and dried to obtain the magnetic toner (1).

100 parts by mass of this toner particle 1, 1.0 parts by mass of hydrophobic fine silica powder (a silica having 12 nm of average primary particle size per number was treated with hexamethyldisilazane and then silicone oil treated) having 120 $m^2/g$ of the BET ration surface area, and 0.1 parts by mass of the PMMA resin particle having 0.15 μm of the average particle size per number, was mixed by using a Henschel Mixer (Mitsui Miike Kakoki K. K.), to prepare the magnetic toner (1) having a number average particle size of 6.5 μm. The physical properties of the magnetic toner (1) are shown in Table 2.

<Manufacturing of the Magnetic Toner (2)>

The magnetic toner (2) was manufactured in the same manner as the manufacturing of the magnetic toner (1) except that instead of using the surface treatment magnetic powder 1, the surface treatment magnetic powder 2 was used, and the volume of the disperse stabilizing agent was adjusted.

<Manufacturing of the Magnetic Toner (3)>

The magnetic toner (3) was manufactured in the same manner as the manufacturing of the magnetic toner (1) except that instead of using the surface treatment magnetic powder 1, the surface treatment magnetic powder 3 was used, and the volume of the dispersion stabilizing agent was adjusted.

<Manufacturing of the Magnetic Toner (4)>

The magnetic toner (4) was manufactured in the same manner as the manufacturing of the magnetic toner (1) except that instead of using the surface treatment magnetic powder 1, the surface treatment magnetic powder 4 was used, and the volume of the dispersing stabilizing agent was adjusted.

<Manufacturing of the Magnetic Toner (5)>

The magnetic toner (5) was manufactured in the same manner as the manufacturing of the magnetic toner (1) except that instead of using the surface treatment magnetic powder 1, the surface treatment magnetic powder 5 was used, and the volume of the dispersing stabilizing agent was adjusted.

<Manufacturing of the Magnetic Toner (6)>

The magnetic toner (6) was manufactured in the same manner as the manufacturing of the magnetic toner (1) except that instead of using the surface treatment magnetic powder 1, the surface treatment magnetic powder 6 was used, and the volume of the dispersing stabilizing agent was adjusted. The physical properties of the magnetic toners (2), (3), (4), (5) and (6) are shown in Table 2.

TABLE 2

| | Number Average Particle Size (μm) | Average Degree of Circularity | Standard Deviation of Degree of Circularity | Magnetization□Am²/kg□ Residual Magnetization σr | M/σs(%) in 0.5 kOe | M/σs(%) in 0.7 kOe | σs in 1 kOe |
|---|---|---|---|---|---|---|---|
| Magnetic Toner (1) | 6.5 | 0.981 | 0.023 | 1.06 | 56.9% | 77.9% | 23.3 |
| Magnetic Toner (2) | 6.8 | 0.982 | 0.023 | 1.17 | 57.4% | 77.0% | 25.3 |
| Magnetic Toner (3) | 6.5 | 0.980 | 0.024 | 2.00 | 63.3% | 81.3% | 27.8 |
| Magnetic Toner (4) | 7.1 | 0.979 | 0.023 | 2.21 | 71.6% | 85.8% | 26.1 |
| Magnetic Toner (5) | 6.8 | 0.981 | 0.024 | 2.28 | 61.8% | 79.9% | 34.8 |
| Magnetic Toner (6) | 6.7 | 0.980 | 0.023 | 2.81 | 65.8% | 82.4% | 30.2 |

It is understood that in order to keep the image density, the fogged image, and the resolution within a tolerance, the magnetic toner should have the magnetic properties as shown below. That is, when 79.6 kA/m (1000 oersteds) of the magnetic field is applied to the toner, the saturation magnetization σs is 20 $Am^2$/kg or more and 37 μm/kg or less. Further, when the magnetic field is lowered to 55.7 kA/m (700 oersteds), the magnetization of the toner is 70% or more and 80% or less of the saturation magnetization vs. Moreover, when the magnetic field is lowered to 39.8 kA/m (500 oersteds), the magnetization of the toner is 50% or more and 62% or less of the saturation magnetization vs. In order to gain the aforementioned magnetic properties, the magnetic properties of the magnetic toner were varied in experiments. The result will be described in greater detail hereinafter.

<Preparation of Developing Apparatus for Evaluation>

As shown in Table 3, the cartridge for the laser beam printer-LBP-1210 (manufactured by Canon Inc.) was modified in such a way that that the developing sleeve 41 of the developing apparatus 4 has an outer diameter of 10 mm as the cartridge (1) and an outer diameter of 8 mm as the cartridge (2).

A coating layer was prepared on the toner coated surface of the developing sleeve 41. The configuration of the coating layer is shown as below.

100 parts by mass of phenol resin 90 parts by mass of graphite (particle size approximately 7 μm)

10 parts by mass of carbon black

The cartridge (3), which forms the coating layer of the above configuration and has a developing sleeve with an outer diameter of 12 mm was prepared.

For comparison, the cartridge for the laser beam printer—LBP-1310(manufactured by Canon Inc.) was prepared in such a way that the cartridges (4) and (5) of the configuration mentioned above have the developing sleeves with an outer diameter of 16 mm and 12 mm, respectively.

The entire cartridge used is set to have the nearest SD gap G of 300 μm. A urethane blade, as the developing blade 44A, having a thickness of 1.0 mm and a free length of 0.70 mm abuts at a linear pressure of 39.2 N/m (40 g/cm).

TABLE 3

| | Outer Diameter of Drum (mm) | Outer Diameter of Sleeve (mm) | Magnetic Flux Density in Developing Polar (mT) | Nearest SD gap (μm) |
|---|---|---|---|---|
| Cartridge (1) | 24 | 10 | 73 | 300 |
| Cartridge (2) | 24 | 8 | 68 | 300 |
| Cartridge (3) | 24 | 12 | 79 | 300 |
| Cartridge (4) | 30 | 16 | 88 | 300 |
| Cartridge (5) | 30 | 12 | 79 | 300 |

Embodiment 1

The cartridge (1) in Table 3 was used for a developing apparatus for evaluation purpose. The cartridge (1) was filled with the magnetic toner (1) of Table 2, and inserted into the laser beam printer-LBP-1210 (manufactured by Canon Inc.). A printing test was conducted for an image output of 1000 sheets under room temperature and room humidity (23° C., 60% RH). As an image for durability, a character (8 point) with the coverage rate of 4% image was used. An A4-sized sheet of 75 g/$m^2$ was used as a recording medium.

The latent image potential on the photosensitive drum 1 was set as Vd=−600(V) and Vl=−150(V). The developing bias potential was set as Vpp=1600(V). As a tentative DC bias component, it was set as Vdc=−450(V) and (Vmax=−1250 (V) and Vmin=+350(V)). Prior to conducting the printing test for the image-output of 1000 sheet, the Vdc value was adjusted so that the measurement value of the black image of a 5-mm-square printed in the center and the four corners of the printing sheet measured by a Macbeth reflection density measuring apparatus (manufactured by Gretag-Macbeth AG) was approximately 1.4.

Image Density

For the image density test, prior to and after the printing test of the image-output of 1000 sheets, a solid image portion was formed on the entire surface of the printing sheet and the solid image was measured by using a Macbeth reflection density measuring apparatus (manufactured by Gretag-Macbeth AG).

Fogged Image

Prior to and after the printing test of the image output of 1000 sheets, a white image was output to measure the fogged image on the paper and an estimation was conducted on the basis mentioned below. The fogged image was measured by REFLECTMETER MODEL TC-6DS manufactured by Tokyo Denshoku Co., Ltd. For a filter, a green filter was used and the fogged image was calculated by the below mentioned formula (3).

Fogged image (reflectivity) (%)=reflectivity (%) of the standard paper−reflectivity (%) of sample non-image portion (3)

The estimation criteria of the fogged image are shown as below.

A: Extremely excellent (less than 1.5%)

B: Excellent (not less than 1.5% and less than 2.5%)

C: Good (not less than 2.5% and less than 4.0%)

D: Poor (not less than 4.0%)

Resolution

Prior to and after the printing test of the image output of 1000 sheets, an evaluation was conducted by outputting a plurality of fine characters and test charts having several types of thin lines (ex. test chart R-1 by the Society of Electrophotography of Japan).

The result of the evaluation was shown in Table 4. In the table, the value of the density is the lowest in the measured sample and the fogged image is the highest in the measured sample Embodiments 2 and 3

As the developing apparatus for the evaluation, the cartridge (1) shown in Table 3 was used and filled with the magnetic toners (2) and (5) shown in Table 2 and a printing test was conducted as in Embodiment 1. Table 4 shows the results.

Embodiments 4, 5, and 6

As the developing apparatus for the evaluation, the cartridge (2) shown in Table 3 was used and was filled with the magnetic toners (1) (2) and (5) shown in Table 2 and a printing test was conducted as in Embodiment 1. Table 4 shows the results. Since the cartridge (2) has the smallest sleeve diameter and the inside magnetic field is weak, some fogged images were observed in the magnetic toner (1) that have a relatively low magnetization. However, the fogged image observed was within an allowable range. When the diameter of the developing sleeve was smaller than 8 mm, which is the value of the present embodiment, the image density was lowered and fogged image was out of the allowable range. Accordingly, the diameter of the developing sleeve should be not less than 8 mm.

Embodiments 7, 8, and 9

As the developing apparatus for the evaluation, the cartridge (3) shown in Table 3 was used and was filled with the magnetic toner (1) (2) and (5) shown in Table 2 and a printing test was conducted as in Embodiment 1. Table 4 shows the results.

In the abovementioned Embodiments 1 through 9, when the magnetic toner (1) was used, more fogged images were observed. However, there was no problem in the resolution and gradation. While the magnetic toner (5) has a lower density and an inferior gradation, it is within an allowable level.

Comparative Examples 1, 2, and 3

As the developing apparatus for the evaluation, the cartridge (1) shown in Table 3 was used and was filled with the magnetic toners (3) (4) and (6) shown in Table 2 were filled and a printing test was conducted as in Embodiment 1. Table 4 shows the results.

In all cases, although the density and the fogged image were within an allowable range, they were not preferable since the reproducibility of the thin lines, the gradation in the half tone, and the like were all inferior.

Comparative Examples 4 and 5

As the developing apparatus for the evaluation, the cartridge (2) shown in Table 3 was used and was filled with the magnetic toners (3) and (4) shown in Table 2 and a printing test was conducted as in Embodiment 1. Table 4 shows the results.

In all cases, although the fogged image was within an allowable range, the density was rather thin. In particular, the magnetic toner (4) is not preferable since the gradation conspicuously deteriorated in the half tone images and the color of the thin lines was weak and exhibited blur.

Comparative Examples 6 and 7

As the developing apparatus for the evaluation, the cartridge (3) shown in Table 3 was used and was filled with the magnetic toners (3) and (4) shown in Table 2 and a printing test was conducted as in Embodiment 1. Table 4 shows the results.

In all cases, although the density and the fogged image were within an allowable range, they are not preferable since the reproducibility of the thin lines, the gradation in the half tone images and the like are at the same level as Comparative Examples 1 and 2.

Comparative Examples 8, 9, and 10

As the developing apparatus for the evaluation, the cartridge (4) shown in Table 3 was used and was filled with the magnetic toners (3) (4) and (6) shown in Table 2. They were inserted in the laser beam printer-LBP-1310 (manufactured by Canon Inc.) and a printing test for the image-output of 1000 sheets was conducted under room temperature and room humidity (23° C., 60% RH).

The latent image potential on the photosensitive drum 1 was set as Vd=−600(V) and Vl=−150(V) as in Embodiment 1. The developing bias potential was set as Vpp=1600(V). As a tentative DC bias component, it was set as Vdc=−450(V). As with the Embodiment 1, the Vdc was adjusted so that a value of the 5 mm-square black images measured by a Macbeth reflection density measuring apparatus (manufactured by Gretag-Macbeth AG) was approximately 1.4. In addition, the images for the durability test and the recording medium were prepared as in Embodiment 1. Table 4 shows the results.

In all cases, the gradation in the half tone images is inferior, but within an allowable range. It is not preferable since the diameter of the developing sleeve is 16 mm, requiring the apparatus to be larger than the developing sleeve having a diameter of not more than 12 mm, which is suitable for compactness of the apparatus.

Comparative Examples 11, 12, and 13

As the developing apparatus for the evaluation, the cartridge (5) shown in Table 3 was used and was filled with the magnetic toners (3) (4) and (6) shown in Table 2 and a printing test was conducted as in Embodiment 1. Table 4 shows the results.

They are not preferable since the result shows almost a similar tendency as in Comparative Examples 1, 2, and 3, in which, the reproducibility of the thin lines, the gradation in the half tone image and the like were inferior.

When compared with Comparative Examples 4, 5, and 6, it can be assumed that in the case of Comparative Examples 4, 5, and 6 since the diameters of the developing sleeves were larger, they have more supplementary time and space to reproduce the thin lines in the "toner rearranging region" and to produce a half tone gradation, whereas Comparative Examples 7, 8, and 9 allow no such time and space.

When compared with Comparative Examples 8, 9, and 10, it can be assumed that in the case of Comparative Examples 8, 9, and 10 since the diameters of the developing sleeves are larger, they have more supplementary time and space to reproduce thin lines in the "toner rearranging region" and to produce a half tone gradation, whereas Comparative Examples 11, 12, and 13 allow no such time and space.

TABLE 4

| | Cartridge used | Toner used | Density | Fogged Image | Image resolution, etc. |
|---|---|---|---|---|---|
| Example 1 | Cartridge (1) | Magnetic Toner (1) | 1.43 | B | Excellent |
| Example 2 | Cartridge (1) | Magnetic Toner (2) | 1.42 | A | Excellent |
| Example 3 | Cartridge (1) | Magnetic Toner (5) | 1.39 | A | Good |
| Example 4 | Cartridge (2) | Magnetic Toner (1) | 1.44 | C | Excellent |
| Example 5 | Cartridge (2) | Magnetic Toner (2) | 1.41 | A | Excellent |
| Example 6 | Cartridge (2) | Magnetic Toner (5) | 1.39 | A | Rather Poor |
| Example 7 | Cartridge (3) | Magnetic Toner (1) | 1.40 | B | Excellent |
| Example 8 | Cartridge (3) | Magnetic Toner (2) | 1.42 | A | Excellent |
| Example 9 | Cartridge (3) | Magnetic Toner (5) | 1.39 | A | Good |
| Comparative Example 1 | Cartridge (1) | Magnetic Toner (3) | 1.40 | A | Poor |
| Comparative Example 2 | Cartridge (1) | Magnetic Toner (4) | 1.42 | A | Poor |
| Comparative Example 3 | Cartridge (1) | Magnetic Toner (6) | 1.38 | A | Poor |
| Comparative Example 4 | Cartridge (2) | Magnetic Toner (3) | 1.38 | A | Poor |
| Comparative Example 5 | Cartridge (2) | Magnetic Toner (4) | 1.35 | A | Quite Poor |
| Comparative Example 6 | Cartridge (3) | Magnetic Toner (3) | 1.41 | A | Poor |
| Comparative Example 7 | Cartridge (3) | Magnetic Toner (4) | 1.40 | A | Poor |
| Comparative Example 8 | Cartridge (4) | Magnetic Toner (3) | 1.42 | A | Good |
| Comparative Example 9 | Cartridge (4) | Magnetic Toner (4) | 1.42 | A | Rather Poor |
| Comparative Example 10 | Cartridge (4) | Magnetic Toner (6) | 1.40 | A | Rather Poor |
| Comparative Example 11 | Cartridge (5) | Magnetic Toner (3) | 1.40 | A | Poor |
| Comparative Example 12 | Cartridge (5) | Magnetic Toner (4) | 1.42 | A | Poor |
| Comparative Example 13 | Cartridge (5) | Magnetic Toner (6) | 1.39 | A | Poor |

<Manufacturing of the Magnetic Toner (7)>

The magnetic toner (7) was manufactured as in the case of manufacturing the magnetic toner (1) except that the content of the surface treatment magnetic powder 1 used in the manufacture of the magnetic toner (1) was adjusted from 90 parts by mass to 70 parts by mass. The physical properties of the magnetic toner (7) are shown in Table 5.

<Manufacturing of the Magnetic Toner (8)>

The magnetic toner (8) was manufactured as in the case of manufacturing the magnetic toner (1) except that the content of the surface treatment magnetic powder 2 used in the manufacture of the magnetic toner (2) was adjusted from 90 parts by mass to 70 parts by mass. The physical properties of the magnetic toner (8) are shown in Table 5.

<Manufacturing of the Magnetic Toner (9)>

The magnetic toner (9) was manufactured as in the case of manufacturing the magnetic toner (1) except that the content of the surface treatment magnetic powder 1 used in the manufacture of the magnetic toner (1) was adjusted from 90 parts by mass to 120 parts by mass. The physical properties of the magnetic toner (9) are shown in Table 5.

<Manufacturing of the Magnetic Toner (10)>

The magnetic toner (10) was manufactured as in the case of manufacturing the magnetic toner (1) except that the content of the surface treatment magnetic powder 1 used in the manufacture of the magnetic toner (1) was adjusted from 90 parts by mass to 120 parts by mass. The physical properties of the magnetic toner (10) are shown in Table 5.

<Manufacturing of the Magnetic Toner (11)>

100 parts by mass of the styrene/n-butylacrylate copolymer (mass ratio 83/17)

0.3 parts by mass of the saturated polyester resin used in the manufacture of the magnetic toner (1)

1 parts by mass of the charge control resin 1

90 parts by mass of the surface treatment magnetic powder 1

10 parts by mass of the ester wax used in the manufacture of the magnetic toner (1)

The abovementioned materials are mixed by a blender, fused and kneaded by a biaxial extruder that is heated at 110° C. to obtain a kneaded material. The kneaded material was cooled and roughly ground by a hammer mill. The roughly ground material was further ground finer by a jet mill. The given fine ground material was classified by wind force to obtain a magnetic toner particle. 100 parts by mass of the magnetic toner particle was mixed with 1.0 parts by mass of silica and 0.1 part by mass of PMMA resin with 0.15 μm of the average particle size per number used in the manufacture of the magnetic toner (1) by a Henschel Mixer (Mitsui-Miike Kakoki K. K.) to prepare the magnetic toner (11) with 6.5 μm of the average particle size per number. The physical properties of the magnetic toner (11) are shown in Table 5.

<Manufacturing of the Magnetic Toner (12)>

The magnetic toner particle obtained in the manufacture of the magnetic toner (11) was given a treatment for 3 minutes at a rotary motion of 6000 revolutions three times by using a hybridizer (manufactured by Nara Machinery Co., Ltd.) to obtain the magnetic toner particles (12). 100 parts by mass of the magnetic toner particles were mixed with 1.0 part by mass of silica and 0.1 part by mass of PMMA resin with 0.15 μm of the average particle size per number used in the manufacture of the magnetic toner (1) by using a Henschel Mixer (Mitsui-Miike Kakoki K. K.) to prepare the magnetic toner (12). The physical properties of the magnetic toner (12) are shown in Table 5.

TABLE 5

| | Number Average Particle Size (μm) | Average Circularity | Circularity Standard Deviation | Magnetization ($Am^2/kg$) Residual Magnetization | M/σs(%) in 0.5 kOe | M/σs(%) in 0.7 kOe | σs in 1 kOe |
|---|---|---|---|---|---|---|---|
| Magnetic Toner (7) | 6.8 | 0.979 | 0.023 | 0.96 | 56.9% | 77.6% | 20.2 |
| Magnetic Toner (8) | 6.5 | 0.972 | 0.032 | 1.54 | 58.8% | 79.1% | 36.9 |
| Magnetic Toner (9) | 6.5 | 0.981 | 0.023 | 0.60 | 52.9% | 72.7% | 18.7 |
| Magnetic Toner (10) | 6.5 | 0.975 | 0.028 | 1.80 | 57.5% | 78.5% | 38.1 |
| Magnetic Toner (11) | 6.5 | 0.939 | 0.051 | 1.51 | 55.9% | 76.2% | 32.4 |
| Magnetic Toner (12) | 6.7 | 0.963 | 0.036 | 1.43 | 57.5% | 78.0% | 32.2 |

Embodiments 10 and 11

As the developing apparatus for evaluation, the cartridge (1) shown in Table 3 was used and was filled with the magnetic toners (7) and (8) shown in Table 5 and a printing test was conducted as in Embodiment 1. Table 6 shows the results.

In Embodiment 10, the fogged image and the resolution were somewhat deteriorated, but they were within an allowable range. In Embodiment 11, the solid density was somewhat weaker, but within an allowable range.

Comparative Examples 14 and 15

As the developing apparatus for the evaluation, the cartridge (1) shown in Table 3 was used and was filled with the magnetic toners (9) and (10) shown in Table 5 and a printing test was conducted as in Embodiment 1. Table 6 shows the results.

In Comparative Example 14, the fogged image was very bad and the spatter of the particle was somewhat observed. This may be led by a low magnetization of the magnetic toner (9). In Comparative Example 15, both the fogged image and the resolution was excellent. However, either the solid density or the gradation in the half tone was not good. This may be led by a too high magnetization of the magnetic toner (10).

Embodiment 12

As the developing apparatus for the evaluation, the cartridge (1) shown in Table 3 was used and was filled with the magnetic toner (12) shown in Table 5 and a printing test was conducted as in Embodiment 1. Table 6 shows the results.

Comparative Example 16

As the developing apparatus for the evaluation, the cartridge (1) shown in Table 3 was used and was filled with the magnetic toner (11) shown in Table 5 and a printing test was conducted as in Embodiment 1. Table 6 shows the results.

In Comparative Example 16, the fogged image and the resolution were both inferior. Since the difference in the physical properties with the magnetic toner (12) exists only in the shape (degree of circularity), it may be assumed that the difference of the shape has caused a great difference in the result.

TABLE 6

| | Cartridge used | Toner used | Density | Fogged Image | Image resolution, etc. |
|---|---|---|---|---|---|
| Example 10 | Cartridge (1) | Magnetic Toner (7) | 1.44 | B | Rather Poor |
| Example 11 | Cartridge (1) | Magnetic Toner (8) | 1.37 | A | Excellent |
| Example 12 | Cartridge (1) | Magnetic Toner (12) | 1.42 | A | Excellent |
| Comparative Example 14 | Cartridge (1) | Magnetic Toner (9) | 1.44 | D | Rather Poor |
| Comparative Example 15 | Cartridge (1) | Magnetic Toner (10) | 1.30 | A | Rather Poor |
| Comparative Example 16 | Cartridge (1) | Magnetic Toner (11) | 1.42 | C | Poor |

As described above, it is not desirable that a sufficient magnetic binding force cannot be provided when the magnetic field of 79.6 kA/m (1000 oersteds) is applied and the saturation magnetization σs is less than 20 $\mu m^2/kg$. In addition, it is not desirable that the magnetic binding force is too strong when the saturation magnetization σs is more than 38 $\mu m^2/kg$.

Accordingly, as appropriate magnetic properties of the magnetic toner according to the present invention, the saturation magnetization σs when the magnetic field of 79.6 kA/m (1000 oersteds) is applied should be not more than 37 $\mu m^2/kg$ and not less than 20 $\mu m^2/kg$. More preferably, it is desirable that the abovementioned saturation magnetization σs is not more than 33 $\mu m^2/kg$ and not less than 25 $\mu m^2/kg$.

For maintaining the developing reproducibility, it is required to have the magnetization that is not less than 70% and not more than 80% of the saturation magnetization σs when the magnetic field is reduced to 55.7 kA/m (700 oersteds), and the magnetization that is not less than 50% and not more than 62% of the saturation magnetization σs when the magnetic field is reduced to 39.8 kA/m (500 oersteds).

Preferably, under the condition when the intensity of the magnetization of 500 oersteds is not more than 75% of the magnetization of 700 oersteds, a better resolution and a better latent image reproducibility will be obtained.

Since when the average degree of circularity of the magnetic toner is low, the resolution tends to deteriorate, it is desirable that the average degree of circularity of the magnetic toner is not less than 0.960.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-280337 filed on Oct. 13, 2006, which is hereby incorporated by reference herein in its entirety.

What is claimed is:

1. A developing apparatus comprising:

a cylindrical developer carrying member disposed opposite to an image bearing member with a gap between said developer carrying member and the image bearing member, said developer carrying member carrying and conveying a magnetic mono-component developer, said developer carrying member developing an electrostatic image formed on the image bearing member with the developer; and a magnetic field generating member disposed in said developer carrying member, wherein an alternate electric field is formed between the image bearing member and said developer carrying member, wherein said developer carrying member has an outer diameter of not less than 8 mm and not more than 12 mm, wherein said magnetic mono-component developer has: a saturation magnetization of not less than 20 $AM^2/kg$ and not more than 37 $AM^2/kg$ in a magnetic field of 1000 oersteds;

a magnetization of not less than 70% and not more than 80% of the saturation magnetization when the magnetic field is lowered to 700 oersteds;

a magnetization of not less than 50% and not more than 62% of the saturation magnetization, when the magnetic field is lowered to 500 oersteds; and an average degree of circularity of not less than 0.960.

2. A developing apparatus according to claim 1, wherein said developing apparatus is detachably mountable to a main body of an image forming apparatus having the image bearing member.

3. A developing apparatus according to claim 1, wherein together with the image bearing member, said developing apparatus is provided in a process cartridge, which is detachably mountable to a main body of an image forming apparatus.

* * * * *